US009394671B2

(12) United States Patent
Hirozawa et al.

(10) Patent No.: US 9,394,671 B2
(45) Date of Patent: Jul. 19, 2016

(54) CONTROL DEVICE AND CONSTRUCTION MACHINE PROVIDED THEREWITH

(71) Applicant: KOBELCO CONSTRUCTION MACHINERY CO., LTD., Hiroshima-shi (JP)

(72) Inventors: Mitsunori Hirozawa, Hiroshima (JP); Koji Ueda, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 14/385,262

(22) PCT Filed: Feb. 12, 2013

(86) PCT No.: PCT/JP2013/000747

§ 371 (c)(1),
(2) Date: Sep. 15, 2014

(87) PCT Pub. No.: WO2013/145528

PCT Pub. Date: Oct. 3, 2013

(65) Prior Publication Data

US 2015/0066313 A1 Mar. 5, 2015

(30) Foreign Application Priority Data

Mar. 27, 2012 (JP) ..... 2012-070833

(51) Int. Cl.

| | |
|---|---|
| ***E02F 9/20*** | (2006.01) |
| ***E02F 9/22*** | (2006.01) |
| ***F15B 11/17*** | (2006.01) |
| ***E02F 3/43*** | (2006.01) |
| ***F15B 11/024*** | (2006.01) |

(52) U.S. Cl.

CPC ..... *E02F 9/2239* (2013.01); *E02F 3/435* (2013.01); *E02F 9/2066* (2013.01);

(Continued)

(58) Field of Classification Search

None

See application file for complete search history.

(56) References Cited

U.S. PATENT DOCUMENTS 6,020,651 A * 2/2000 Nakamura ..... E02F 9/2235 123/496
6,666,022 B1 * 12/2003 Yoshimatsu ..... B60K 6/46 60/413

(Continued)

FOREIGN PATENT DOCUMENTS

CN 101230869 A 7/2008
JP 9-60605 A 3/1997

(Continued)

OTHER PUBLICATIONS

International Search Report issued May 28, 2013, in PCT/JP13/000747 filed Feb. 12, 2013.

(Continued)

*Primary Examiner* — Jonathan M Dager

(74) *Attorney, Agent, or Firm* — Oblon, McClelland, Maier & Neustadt, L.L.P

(57) ABSTRACT

A control device is configured to sufficiently reduce the drive loss of a hydraulic pump. The control device is provided with a controller configured to control a regeneration valve to switch to a regeneration state, and to control the flow rate of a second hydraulic pump to reduce the ejection flow rate of the second hydraulic pump in accordance with regeneration of hydraulic oil through the regeneration valve when a combined operation of lowering a boom and pressing an arm is performed. The controller outputs a command for setting the number of rotations of an engine to be smaller than the rotation number designated by a rotation number designating unit when the ejection flow rate of the second hydraulic pump is not larger than a predetermined flow rate during the combined operation.

8 Claims, 7 Drawing Sheets

(52) U.S. Cl.
CPC ..... *E02F 9/2217* (2013.01); *E02F 9/2246* (2013.01); *E02F 9/2285* (2013.01); *E02F 9/2292* (2013.01); *E02F 9/2296* (2013.01); *F15B 11/024* (2013.01); *F15B 11/17* (2013.01); *F15B 2211/20523* (2013.01); *F15B 2211/20576* (2013.01); *F15B 2211/3058* (2013.01); *F15B 2211/30595* (2013.01); *F15B 2211/41527* (2013.01); *F15B 2211/41581* (2013.01); *F15B 2211/6309* (2013.01); *F15B 2211/6313* (2013.01); *F15B 2211/6316* (2013.01); *F15B 2211/6346* (2013.01); *F15B 2211/665* (2013.01); *F15B 2211/6651* (2013.01); *F15B 2211/6652* (2013.01); *F15B 2211/6654* (2013.01); *F15B 2211/78* (2013.01); *F15B 2211/88* (2013.01)

(56) References Cited

U.S. PATENT DOCUMENTS 7,745,947 B2 * 6/2010 Komiyama ..... B60K 6/48 180/307
8,362,629 B2 * 1/2013 Weber ..... F04B 1/04 187/224
8,407,993 B2 * 4/2013 Vigholm ..... E02F 9/2207 60/327
8,532,855 B2 * 9/2013 Koga ..... E02F 9/123 180/65.265
8,534,264 B2 * 9/2013 Kawaguchi ..... E02F 9/2075 123/350
8,700,275 B2 * 4/2014 Edamura ..... E02F 9/123 701/29.1
8,924,100 B2 * 12/2014 Imura ..... B60W 10/06 701/36
8,958,958 B2 * 2/2015 Imura ..... E02F 9/123 180/53.1
9,013,050 B2 * 4/2015 Yamashita ..... H02P 9/00 290/40 R
9,071,054 B2 * 6/2015 Min ..... B60L 11/123
2002/0125052 A1 * 9/2002 Naruse ..... B60K 6/12 180/53.8
2003/0132729 A1 * 7/2003 Yoshimatsu ..... E02F 9/2075 320/104
2003/0221339 A1 * 12/2003 Naruse ..... E02F 9/2217 37/348
2003/0226291 A1 * 12/2003 Naruse ..... E02F 9/2221 37/348
2004/0148817 A1 * 8/2004 Kagoshima ..... B60K 6/12 37/348
2004/0222000 A1 * 11/2004 Ohtsukasa ..... E02F 9/2075 172/2
2005/0001606 A1 * 1/2005 Kagoshima ..... B60K 6/46 323/371
2005/0036894 A1 * 2/2005 Oguri ..... E02F 9/2075 417/212
2005/0065689 A1 * 3/2005 Budde ..... E02F 3/845 701/50
2006/0243260 A1 * 11/2006 Ichijo ..... B60K 6/365 123/559.3
2007/0096667 A1 * 5/2007 Komiyama ..... B60Q 1/50 318/98
2007/0214782 A1 * 9/2007 Komiyama ..... B60K 6/46 60/431
2008/0300757 A1 * 12/2008 Kanayama ..... E02F 9/9025 701/50
2009/0036264 A1 * 2/2009 Tozawa ..... B60K 6/22 477/5
2009/0044528 A1 * 2/2009 Narazaki ..... E02F 9/2235 60/452
2009/0301075 A1 * 12/2009 Morinaga ..... B66C 1/42 60/459
2009/0320461 A1 * 12/2009 Morinaga ..... B66F 9/22 60/431
2010/0031650 A1 * 2/2010 Morinaga ..... B60L 1/003 60/459
2010/0064677 A1 * 3/2010 Kawaguchi ..... E02F 9/2075 60/431
2010/0071973 A1 * 3/2010 Morinaga ..... B60K 6/48 180/65.265
2010/0097037 A1 * 4/2010 Morinaga ..... B60K 6/46 322/14
2010/0102763 A1 * 4/2010 Kagoshima ..... B60K 6/46 318/380
2010/0115800 A1 * 5/2010 Sakai ..... F04B 49/20 37/348
2010/0162706 A1 * 7/2010 Sakai ..... E02F 3/325 60/706
2012/0004797 A1 * 1/2012 Baino ..... B60K 6/48 701/22
2012/0240582 A1 * 9/2012 Ooki ..... E02F 9/123 60/711
2012/0296574 A1 * 11/2012 Ooki ..... E02F 9/123 702/35
2012/0315119 A1 * 12/2012 Magaki ..... E02F 9/2075 414/685
2013/0058750 A1 * 3/2013 Hiroki ..... E02F 9/123 414/744.2
2013/0090835 A1 * 4/2013 Take ..... F02D 29/04 701/103
2013/0174556 A1 * 7/2013 Nishikawa ..... E02F 9/123 60/718
2013/0190960 A1 * 7/2013 Kawashima ..... B60W 10/06 701/22
2013/0221746 A1 * 8/2013 Nakayama ..... E02F 9/2075 307/10.1
2013/0227936 A1 * 9/2013 Takahashi ..... E02F 9/2235 60/297
2013/0243557 A1 * 9/2013 Hiroki ..... B60L 11/123 414/687
2013/0269332 A1 * 10/2013 Suk ..... E02F 9/2217 60/420
2013/0275011 A1 * 10/2013 Ota ..... E02F 9/2075 701/50
2013/0325268 A1 * 12/2013 Ishihara ..... E02F 9/2246 701/50
2013/0330160 A1 * 12/2013 Oka ..... E02F 9/2203 414/687
2013/0345939 A1 * 12/2013 Magaki ..... E02F 9/2214 701/50
2014/0090367 A1 * 4/2014 Hijikata ..... E02F 9/2091 60/414
2014/0165543 A1 * 6/2014 Takebayashi ..... F02D 29/04 60/311
2014/0245729 A1 * 9/2014 Nanjo ..... E02F 9/226 60/414
2014/0290237 A1 * 10/2014 Yoshida ..... F02D 41/029 60/452
2015/0176609 A1 * 6/2015 Kawasaki ..... F15B 21/14 60/448

FOREIGN PATENT DOCUMENTS

JP 2010-174574 8/2010
JP 2010-190261 9/2010
WO WO 90/13748 A1 11/1990

OTHER PUBLICATIONS

Extended European Search Report issued Jun. 11, 2015 in Patent Application No. 13767558.3.

* cited by examiner

CONTROL DEVICE AND CONSTRUCTION MACHINE PROVIDED THEREWITH

TECHNICAL FIELD

The present invention relates to a control device for a construction machine including a hydraulic actuator, a hydraulic pump which supplies hydraulic oil to the hydraulic actuator, and an engine which drives the hydraulic pump.

BACKGROUND ART

Conventionally, there is known a working machine disclosed in patent literature 1, for instance.

The working machine disclosed in patent literature 1 is provided with a boom cylinder; an arm cylinder; a hydraulic pump which supplies hydraulic oil to the arm cylinder; an engine which drives the hydraulic pump; a regeneration valve switchable between an opened state, in which hydraulic oil drawn out of a head side chamber of the boom cylinder is guided to a rod side chamber of the arm cylinder, and a closed state; and a controller which controls the regeneration valve to switch to the opened state when a combined operation of lowering a boom and pressing an arm is performed. According to the working machine having the above configuration, it is possible to utilize the position energy of the boom at the time of lowering the boom, as the energy for pressing the arm.

Further, the controller in patent literature 1 is configured to reduce the ejection flow rate of the hydraulic pump in accordance with supply of hydraulic oil from the boom cylinder to the arm cylinder through the regeneration valve during a combined operation. This makes it possible to reduce the workload of the hydraulic pump during a combined operation. Thus, it is possible to enhance the fuel consumption rate of the engine.

In the working machine disclosed in patent literature 1, however, it is impossible to sufficiently reduce the drive loss of the hydraulic pump (the engine) during a combined operation.

Specifically, in the working machine disclosed in patent literature 1, although the ejection flow rate of the hydraulic pump during a combined operation is reduced, a part of the ejection flow rate of the hydraulic pump may be surplus, even if the ejection flow rate of the hydraulic pump is reduced to a minimum flow rate. For instance, in the case where a flow rate obtained by summing up the minimum flow rate of the hydraulic pump and the regenerative flow rate with respect to the boom cylinder exceeds a flow rate required for the arm cylinder, the hydraulic pump ejects the surplus flow rate. In this case, the surplus flow rate ejected from the hydraulic pump is wasted as heat energy for opening a relief valve.

CITATION LIST

Patent Literature

Patent literature 1: Japanese Unexamined Patent Publication No. 2010-190261

SUMMARY OF INVENTION

An object of the invention is to provide a control device that enables to sufficiently reduce the drive loss of a hydraulic pump, and a construction machine incorporated with the control device.

In view of the above, the invention provides a control device for a construction machine provided with a machine body, a boom configured to be raised and lowered with respect to the machine body, and an arm configured to be swingable with respect to the boom. The control device is provided with a boom cylinder which raises and lowers the boom; an arm cylinder which swings the arm; a variable capacity hydraulic pump which supplies hydraulic oil to the arm cylinder; an engine which drives the hydraulic pump; a rotation number designating unit which outputs a command for designating the number of rotations of the engine; a regeneration valve which is switchable between a regeneration state, in which return oil from the boom cylinder at a time of lowering the boom is drawn into a supply side port of the arm cylinder at a time of pressing the arm, and a closed state, in which drawing of the return oil into the arm cylinder is prevented; flow rate detecting means which is configured to detect a value for specifying an ejection flow rate of the hydraulic pump; and a controller which controls an operation of the regeneration valve so that the regeneration valve is switched to the regeneration state, and controls a flow rate of the hydraulic pump so as to reduce the ejection flow rate of the hydraulic pump in accordance with regeneration of hydraulic oil through the regeneration valve at a time of a combined operation of lowering the boom and pressing the arm. The controller outputs a command for setting the number of rotations of the engine to be smaller than the rotation number designated by the rotation number designating unit when the ejection flow rate of the hydraulic pump detected by the flow rate detecting means is not larger than a predetermined flow rate at the time of the combined operation.

The invention also provides a construction machine including a machine body, a boom mounted on the machine body to be raised and lowered, an arm mounted on the boom to be swingable, and the control device having the above configuration.

According to the invention, it is possible to sufficiently reduce the drive loss of the hydraulic pump.

DESCRIPTION OF EMBODIMENTS

Figure 1:
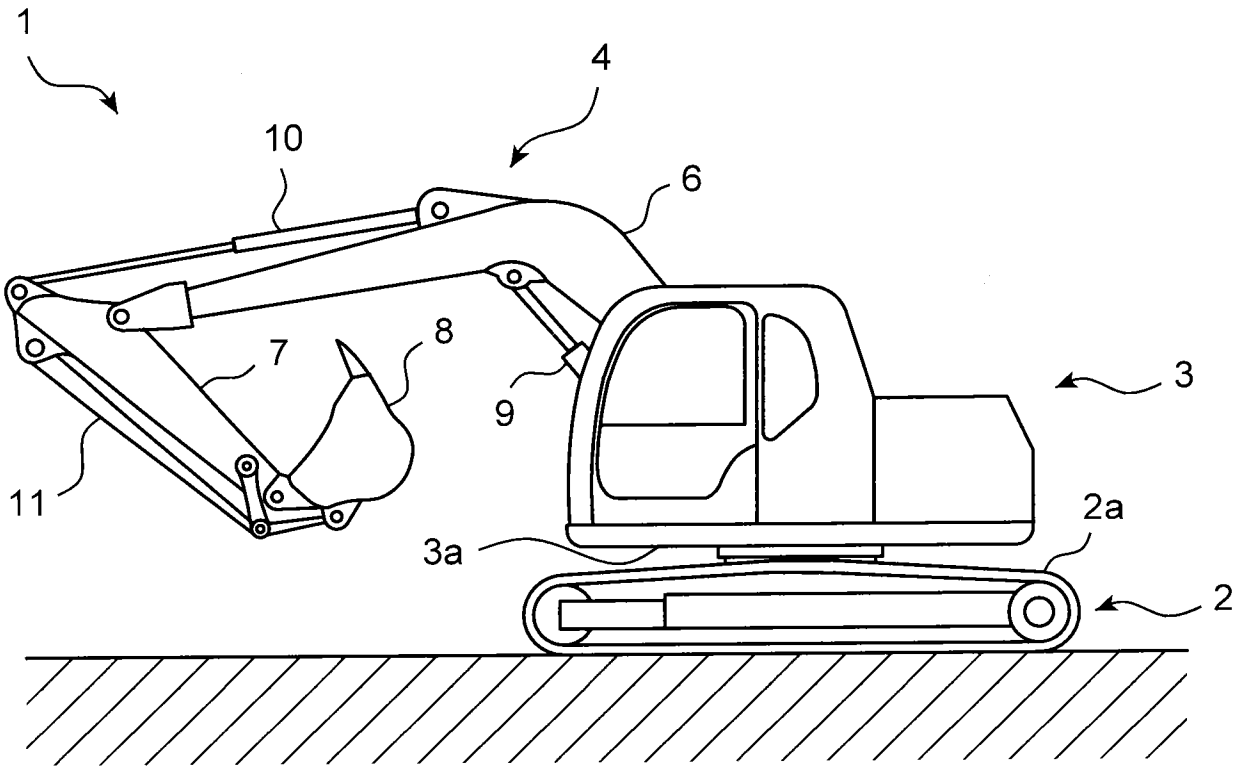
FIG. 1 is a left side view illustrating an overall configuration of a hydraulic shovel embodying the invention.

In the following, an embodiment of the invention is described referring to the drawings. The following embodiment is merely an example embodying the invention, and does not limit the technical range of the invention.

Figure 2:
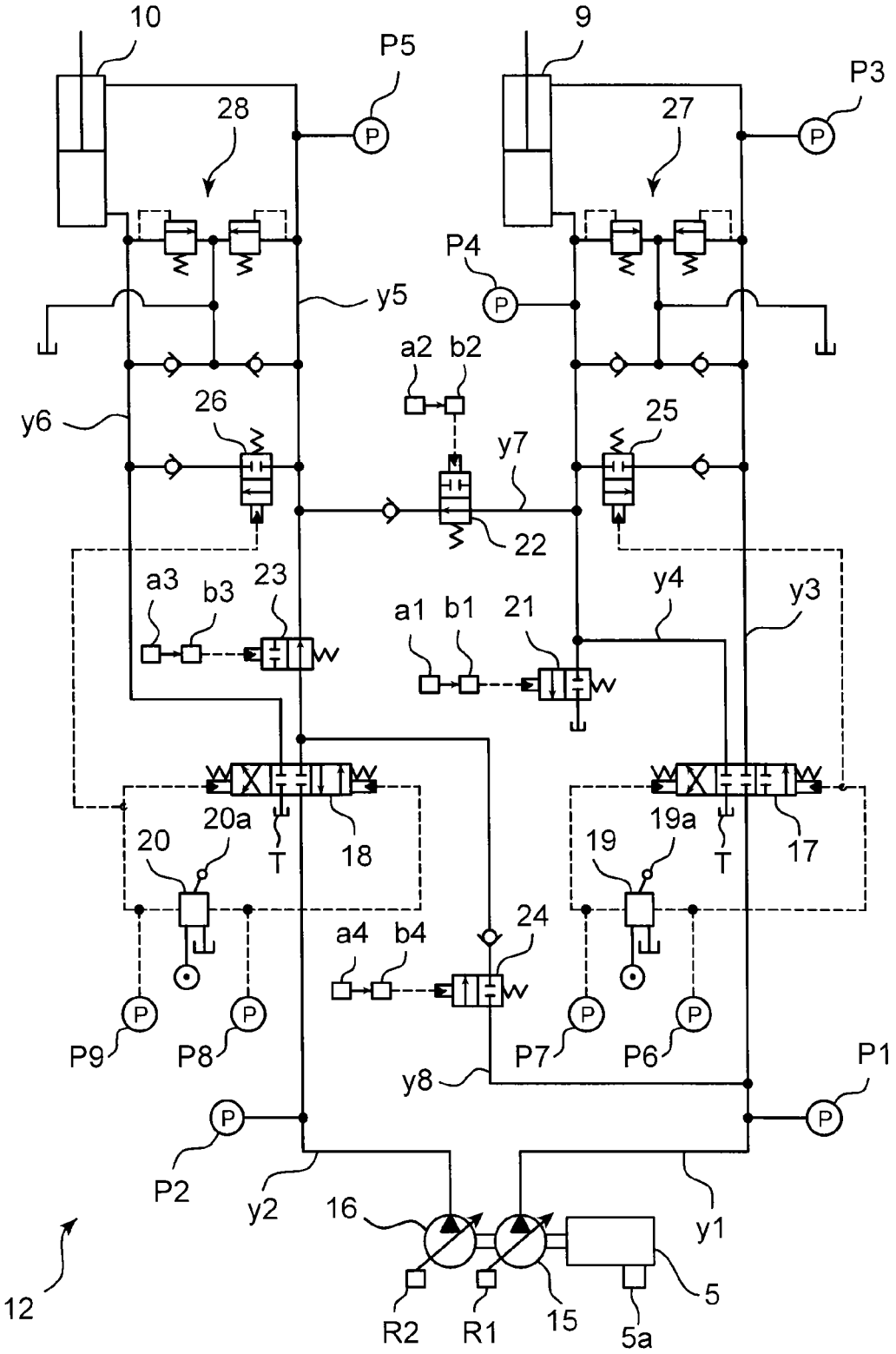
FIG. 2 is a circuit diagram illustrating a drive system of the hydraulic shovel illustrated in FIG. 1.
Figure 3:
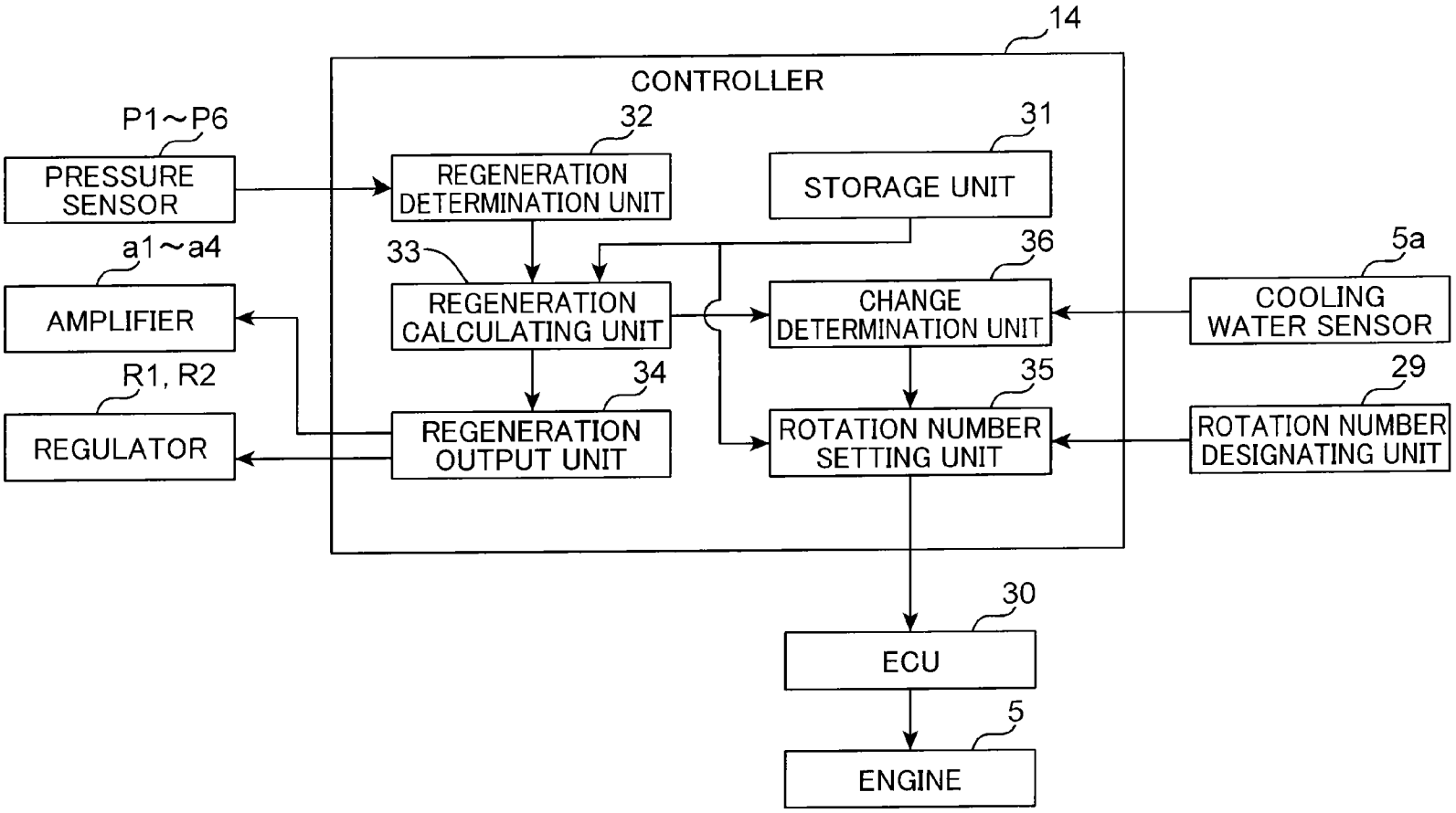
FIG. 3 is a block diagram illustrating a schematic configuration of a controller which controls the drive system illustrated in FIG. 2.

Referring to FIG. 1, a hydraulic shovel 1 as an example of a construction machine embodying the invention is provided with a lower propelling body 2 including a crawler 2*a*, an upper slewing body 3 including an upper frame 3*a* mounted on the lower propelling body 2 to be slewable, a working attachment 4 mounted on the upper frame 3*a* to be movable, a drive system 12 illustrated in FIG. 2, and a controller 14 illustrated in FIG. 3. The hydraulic shovel 1 embodying the invention is configured such that the lower propelling body 2 and the upper slewing body 3 constitute a machine body.

The working attachment 4 is provided with a boom 6 including a base end attached on the upper frame 3*a* to be raised and lowered, an arm 7 including a base end attached to a distal end of the boom 6 to be swingable, and a bucket 8 attached to a distal end of the arm 7 to be swingable. The working attachment 4 is further provided with a boom cylinder 9 configured to raise and lower the boom 6 with respect to the upper frame 3*a*, an arm cylinder 10 configured to swing the arm 7 with respect to the boom 6, and a bucket cylinder 11 configured to swing the bucket 8 with respect to the arm 7.

Referring to FIG. 2, the drive system 12 is provided with a first hydraulic pump 15 for supplying hydraulic oil to the boom cylinder 9, a second hydraulic pump 16 for supplying hydraulic oil to the arm cylinder 10, an engine 5 for driving the hydraulic pumps 15 and 16, a first control valve (a supply-and-discharge control valve) 17 for controlling supply and discharge of hydraulic oil to and from the boom cylinder 9, a remote control valve 19 for operating the first control valve 17, a second control valve 18 for controlling supply and discharge of hydraulic oil to and from the arm cylinder 10, a remote control valve 20 for operating the second control valve 18, a meter-out valve 21, a regeneration valve 22, a meter-in valve 23, a merging valve 24, a boom reproduction valve 25, an arm reproduction valve 26, a relief valve 27, a relief valve 28, pressure sensors P1 to P6, a rotation number designating unit 29 (see FIG. 3), and an ECU 30 (see FIG. 3).

The first hydraulic pump 15 is a pump of a variable capacity type. Specifically, the first hydraulic pump 15 is configured such that the ejection flow rate thereof is adjustable in accordance with a command to be output from a regulator R1. The ejection pressure of the first hydraulic pump 15 is detected by the pressure sensor P1 disposed on an oil path y1 between the first hydraulic pump 15 and the first control valve 17.

The second control valve 16 is a pump of a variable capacity type. Specifically, the second hydraulic pump 16 is configured such that the ejection flow rate thereof is adjustable in accordance with a command to be output from a regulator R2. The ejection pressure of the second hydraulic pump 16 is detected by the pressure sensor P2 disposed on an oil path y2 between the second hydraulic pump 16 and the second control valve 18.

The first control valve 17 is switchable between an illustrated neutral position, a boom lowering position (the right position in FIG. 2) at which the boom cylinder 9 is contracted (to lower the boom 6), and a boom raising position (the left position in FIG. 2) at which the boom cylinder 9 is extended (to raise the boom 6). Specifically, the first control valve 17 is ordinarily urged to the neutral position, and is switched to the boom lowering position or to the boom raising position in accordance with an operation of an operation lever 19*a* of the remote control valve 19. The pressure of hydraulic oil in an oil path y3 connecting between the first control valve 17 and a rod side chamber of the boom cylinder 9 is detected by the pressure sensor P3. The pressure of hydraulic oil in an oil path y4 connecting between the first control valve 17 and a head side chamber of the boom cylinder 9 is detected by the pressure sensor P4. Further, a pilot pressure with respect to the first control valve 17 is detected by the pressure sensor P6 and a pressure sensor P7 disposed on a pilot circuit for connecting between the remote control valve 19 and a spool of the first control valve 17. The pressure sensor P6 constitutes an operation amount detecting unit which is configured to detect an operation amount of the first control valve 17 for lowering the boom.

The second control valve 18 is switchable between an illustrated neutral position, an arm pressing position (the right position in FIG. 2) at which the arm cylinder 10 is contracted (to press the arm 7), and an arm retracting position (the left side in FIG. 2) at which the arm cylinder 10 is extended (to retract the arm 7). Specifically, the second control valve 18 is ordinarily urged to the neutral position, and is switched to the arm pressing position or to the arm retracting position in accordance with an operation of an operation lever 20*a* of the remote control valve 20. The pressure of hydraulic oil in an oil path y5 connecting between the second control valve 18 and a rod side of the arm cylinder 10 is detected by the pressure sensor P5. Further, a pilot pressure with respect to the second control valve 18 is detected by pressure sensors P8 and P9 disposed on a pilot circuit for connecting between the remote control valve 20 and a spool of the second control valve 18.

The meter-out valve 21 is disposed on the oil path y4, and is configured such that the flow rate of hydraulic oil to be discharged from the head side chamber of the boom cylinder 9 to a tank T is adjustable. Specifically, the meter-out valve 21 is ordinarily closed, and is actuated and opened by the pilot pressure from an electromagnetic proportional valve b1. The electromagnetic proportional valve b1 is actuated in response to an electric signal from an amplifier a1.

The regeneration valve 22 is switchable between a regeneration state, in which return oil from the head side chamber of the boom cylinder 9 is drawn into the rod side chamber of the arm cylinder 10, and a closed state, in which drawing of the return oil into the arm cylinder 10 is prevented. Further, the regeneration valve 22 is configured such that the flow rate through the regeneration valve 22 is adjustable by adjusting the switching position between the regeneration state and the closed state. Specifically, the regeneration valve 22 is ordinarily opened, and is actuated in accordance with the pilot pressure from an electromagnetic proportional valve b2. The electromagnetic proportional valve b2 is actuated in response to an electric signal from an amplifier a2. Further, the regeneration valve 22 is disposed on an oil path y7 connecting between a position on the oil path y4 between the boom cylinder 9 and the meter-out valve 21, and a position on the oil path y5 between the arm cylinder 10 and the meter-in valve 23.

The meter-in valve 23 is disposed on the oil path y5, and is configured such that the flow rate of hydraulic oil to be supplied from the second control valve 18 to the arm cylinder 10 is adjustable. Specifically, the meter-in valve 23 is ordinarily opened, and is closed by the pilot pressure from an electromagnetic proportional valve b3. The electromagnetic proportional valve b3 is actuated in response to an electric signal from an amplifier a3.

The merging valve 24 is configured to merge the hydraulic oil from the second hydraulic pump 16 into the hydraulic oil from the first hydraulic pump 15 at the time of pressing the arm. Specifically, the merging valve 24 is disposed on an oil path y8 connecting between the oil path y1, and a position on the oil path y5 between the second control valve 18 and the meter-in valve 23. Further, the merging valve 24 is switchable between a supply state, in which hydraulic oil from the first hydraulic pump 15 is suppliable to the rod side chamber of the arm cylinder 10, and a stop state, in which supply of hydraulic oil from the first hydraulic pump 15 to the arm cylinder 10 is prevented.

The boom reproduction valve 25 is configured to return the hydraulic oil drawn out of the head side chamber of the boom cylinder 9 to the rod side chamber of the boom cylinder 9 at the time of the operation for lowering the boom. Specifically, the boom reproduction valve 25 is ordinarily closed, and is opened in accordance with an operation of the operation lever 19*a*.

The arm reproduction valve 26 is configured to return the hydraulic oil drawn out of the rod side chamber of the arm cylinder 10 to a head side chamber of the arm cylinder 10 at the time of the operation for retracting the arm. The arm reproduction valve 26 is ordinarily closed, and is opened in accordance with an operation of the operation lever 20*a*.

The relief valve 27, 28 is a valve configured to open at a predetermined pressure or higher so that the pressure of hydraulic oil in each of the oil paths y3 to y6 does not exceed the predetermined pressure. The oil path y6 is an oil path connecting between the second control valve 18, and the head side chamber of the arm cylinder 10.

Referring to FIG. 3, the rotation number designating unit 29 is configured to designate the number of rotations of the engine 5. Specifically, the rotation number designating unit 29 is constituted of an accelerator, and is configured to output a command relating to the rotation number to the controller 14 to be described later.

The ECU (Engine Control Unit) 30 is configured to electronically control driving of the engine 5, including the rotation number. Specifically, the ECU is configured to output a command relating to the rotation number to the engine 5 in accordance with a command from the controller 14 to be described later.

Next, the controller 14 is described.

The controller 14 is provided with a storage unit 31 which stores various information, a regeneration determination unit 32 which determines whether regeneration of hydraulic oil is to be performed, a regeneration calculating unit 33 which calculates a regeneration flow rate, a regeneration output unit 34 which outputs a command to the regeneration valve 22 and to each of the hydraulic pumps 15 and 16, a rotation number setting unit 35 which sets the number of rotations of the engine 5, and a change determination unit 36 which determines whether the number of rotations of the engine 5 is to be changed.

The regeneration determination unit 32 is configured to determine whether a combined operation of lowering the boom and pressing the arm is performed. Specifically, the regeneration determination unit 32 determines whether an operation of pressing the arm is performed concurrently with an operation of lowering the boom, based on detection signals from the pressure sensors P6 to P9. Preferably, the regeneration determination unit 32 may determine that the operation of lowering the boom and the operation of pressing the arm are concurrently performed, when the operation amount of the operation lever 19*a* and the operation amount of the operation lever 20*a* are not smaller than a predetermined operation amount, taking into consideration of dead zones of the operation levers 19*a* and 20*a* (see FIG. 2).

Further, the regeneration determination unit 32 is configured to determine whether the pressure in the head side chamber of the boom cylinder 9 exceeds the pressure in the rod side chamber of the arm cylinder 10, based on detection signals from the pressure sensors P4 and P5. This operation is performed because regeneration is performed based on a judgment that the pressure of hydraulic oil to be drawn out of the boom cylinder 9 exceeds the pressure of hydraulic oil to be supplied to the arm cylinder 10.

The regeneration calculating unit 33 calculates an aperture area Ar of the regeneration valve 22, and an ejection flow rate Qp2 of the second hydraulic pump 16 corresponding to the aperture area Ar in performing regeneration. In the following, a method for calculating the aperture area Ar and the ejection flow rate Qp2 is described.

First of all, the regeneration calculating unit 33 specifies a target velocity V1 at which the boom is lowered. Specifically, the target velocity V1 is specified based on a map illustrating a relationship between the operation amount of the operation lever 19*a* and the target velocity V1, which is stored in advance in the storage unit 31, and based on an operation amount of the operation lever 19*a* detected by the pressure sensor P6.

Next, the regeneration calculating unit 33 calculates a maximum regeneration flow rate Qrmax, using the calculated target velocity V1 and the following formula (1).

$$Qr\max = Abh \times V1 - Qrc \quad (1)$$

In the above formula, Abh indicates a sectional area of the head side chamber of the boom cylinder 9, and Qrc indicates a flow rate of hydraulic oil passing through the boom regeneration valve 25. The flow rate Qrc is defined by the following formula (2).

$$Qrc = Cv \times Arc \times \sqrt{(Pbh - Pbr)} \quad (2)$$

In the above formula, Arc indicates a degree of opening of the boom reproduction valve 25, and is specified based on a detection value of the pressure sensor P6. Pbh indicates a pressure of the head side chamber of the boom cylinder 9, and is detected by the pressure sensor P4. Pbr indicates a pressure of the rod side chamber of the boom cylinder 9, and is detected by the pressure sensor P3. Cv indicates a capacity coefficient of the boom reproduction valve 25.

Next, the regeneration calculating unit 33 calculates a target flow rate Qar of hydraulic oil to be necessary to be supplied to the rod side chamber of the arm cylinder 10.

First of all, the regeneration calculating unit 33 specifies a target velocity V2 at which the arm is pressed. Specifically, the target velocity V2 is specified, based on a map illustrating a relationship between the operation amount of the operation lever 20*a* and the target velocity V2, which is stored in advance in the storage unit 31, and based on an operation amount of the operation lever 20*a* detected by the pressure sensor P8.

Next, the regeneration calculating unit 33 calculates the target flow rate Qar with respect to the arm cylinder 10, using the calculated target velocity V2 and the following foimula (3).

$$Qar = Aar \times V2 \quad (3)$$

In the above formula, Aar indicates a sectional area of the rod side chamber of the arm cylinder 10.

Subsequently, the regeneration calculating unit 33 selects a first regeneration pattern when the maximum regeneration flow rate Qrmax>the target flow rate Qar, and selects a second regeneration pattern when the maximum regeneration flow rate Qrmax≤the target flow rate Qar.

[First Regeneration Pattern]

When the first regeneration pattern is selected, it is possible to secure the whole of the target flow rate Qar with respect to the arm cylinder 10 by the maximum regeneration flow rate Qrmax. Therefore, the flow rate (tilt) of the second hydraulic pump 16 is set to be minimum, and the meter-in valve 23 is fully closed.

Further, in the first regeneration pattern, it is necessary to set the flow rate through the regeneration valve 22 to the target flow rate Qar with respect to the arm cylinder 10. In view of the above, the regeneration calculating unit 33 calculates the aperture area Ar of the regeneration valve 22, using the following formula (4).

$$Ar=Qar/\{Cv\times\sqrt{(Pbh-Par)}\} \quad (4)$$

In the above formula, Par indicates a pressure of the rod side chamber of the arm cylinder 10, and is a value detected by the pressure sensor P5. Further, Cv indicates a capacity coefficient of the regeneration valve 22.

In the first regeneration pattern, the meter-out valve 21 is set to a degree of opening at which surplus return oil from the boom cylinder 9 is returned to the tank.

[Second Regeneration Pattern]

When the second regeneration pattern is selected, a part of the target flow rate Qar with respect to the arm cylinder 10 is secured by using the whole of the maximum regeneration flow rate Qrmax. In view of the above, the meter-out valve 21 is fully closed, and the regeneration valve 22 is fully opened.

Further, in the second regeneration pattern, the ejection flow rate of the second hydraulic pump 16 is reduced in correspondence to the maximum regeneration flow rate Qrmax. Specifically, the ejection flow rate (tilt) of the second hydraulic pump 16 is set to be equal to the flow rate obtained by subtracting the maximum regeneration flow rate Qrmax from the ejection flow rate (e.g. the target flow rate Qar) when regeneration is not performed.

In the first regeneration pattern, the second hydraulic pump 16 ejects surplus hydraulic oil at a minimum flow rate thereof (a flow rate corresponding to a minimum tilt thereof), regardless that the ejection flow rate from the second hydraulic pump 16 is not expected. Further, in the second regeneration pattern, when the flow rate obtained by subtracting the maximum regeneration flow rate Qrmax from the target flow rate Qar with respect to the arm cylinder 10 is lower than the minimum flow rate of the second hydraulic pump 16, even if the second hydraulic pump 16 is tilted with a minimum degree of tilt, the second hydraulic pump 16 ejects surplus hydraulic oil. In the first regeneration pattern and in the second regeneration pattern, drive loss of the second hydraulic pump 16 may occur, regardless of reduction of the flow rate of the second hydraulic pump 16. In order to reduce the drive loss, in the embodiment, control of changing the number of rotations of the engine 5 is performed. In the following, a configuration of the control is described.

The rotation number setting unit 35 is configured to output a command relating to the number of rotations of the engine 5 to the ECU 30, based on a command value input from the rotation number designating unit 29. Specifically, the rotation number setting unit 35 outputs a command relating to the rotation number in accordance with a command from the rotation number designating unit 29, when a command indicating a change is not input from the change determination unit 36 to be described later. On the other hand, when a command indicating a change is input from the change determination unit 36, the rotation number setting unit 35 determines an amount of reduction for the number of rotations of the engine 5, and outputs, to the ECU 30, a command relating to the rotation number obtained by subtracting the amount of reduction from the rotation number based on a command, which is output from the rotation number designating unit 29.

Further, the rotation number setting unit 35 determines the amount of reduction for the rotation number in the following manner. First of all, the rotation number setting unit 35 specifies a regeneration flow rate through the regeneration valve 22, based on a map illustrated in FIG. 4 which is stored in advance in the storage unit 31, and based on the pressures detected by the pressure sensors P2 and P4. Specifically, the map illustrated in FIG. 4 describes a regeneration flow rate with respect to a difference between the boom head pressure and the pump ejection pressure. Alternatively, a map describing a regeneration flow rate with respect to a difference between the boom head pressure and the arm rod pressure may be stored in advance in the storage unit 31, and a regeneration flow rate may be specified based on the map and based on the pressures detected by the pressure sensors P4 and P5.

Next, the rotation number setting unit 35 specifies an amount of reduction for the rotation number based on the regeneration flow rate specified as described above, and based on a map illustrated in FIG. 5, which is stored in advance in the storage unit 31. Specifically, the map illustrated in FIG. 5 describes an amount of reduction for the rotation number with respect to a regeneration flow rate. Further, the map describes a range, in which the amount of reduction for the rotation number increases, as the regeneration flow rate increases; and dead zones on both sides of the range, in which the amount of reduction for the rotation number is constant regardless of an increase or a decrease in the regeneration flow rate.

The change determination unit 36 determines whether changing (lowering) the number of rotations of the engine 5 is to be performed by the rotation number setting unit 35. Specifically, the change determination unit 36 performs the following three determinations.

As the first determination, the change determination unit 36 determines whether the ejection flow rate of the second hydraulic pump 16 is not larger than a predetermined value. In the specification, the term "predetermined value" means a flow rate when the tilt of the second hydraulic pump 16 is minimized in a state that the engine 5 is driven at the rotation number designated by the rotation number designating unit 29. The change determination unit 36 in the embodiment determines whether the tilt of the second hydraulic pump 16 is minimum, based on a command value indicating the flow rate (tilt) of the second hydraulic pump 16 calculated by the regeneration calculating unit 33. When the tilt of the second hydraulic pump 16 is minimum, reducing the number of rotations of the engine 5 is permitted, assuming that drive loss of the second hydraulic pump 16 occurs. In other words, the regeneration calculating unit 33 in the embodiment constitutes flow rate detecting means configured to detect a value for specifying an ejection flow rate of the second hydraulic pump 16. The flow rate detecting means may be a flow rate sensor configured to detect an ejection flow rate of the second hydraulic pump 16.

As the second determination, the change determination unit 36 determines whether the rotation number based on a command from the rotation number designating unit 29 is not larger than a predetermined rotation number. In the specification, the term "predetermined rotation number" means the rotation number that defines the lower limit at which the engine is stopped. The change determination unit 36 in the embodiment determines whether a command value indicating the rotation number from the rotation number designating unit 29 is larger than a predetermined value. When the command value indicating the rotation number is larger than the predetermined value, reducing the number of rotations of the engine 5 is permitted, assuming that the engine 5 is less likely to stop.

As the third determination, the change determination unit 36 determines whether the engine 5 is in a warm-up condition. Specifically, the change determination unit 36 in the embodiment determines whether the engine 5 is in a warm-up condition, when a water temperature detected by a cooling water sensor 5*a* provided in the engine 5 is lower than a predetermined temperature. When the engine 5 is in a warm-up condition, the response of the engine 5 in increasing the number of rotations of the engine 5 is poor. In view of the above, reducing the number of rotations of the engine 5 is prohibited when the engine 5 is in a warm-up condition.

In the embodiment, a return flow rate of the boom cylinder 9 at the time of lowering the boom is utilized for the arm cylinder 10 during an operation of pressing the arm at the time of a combined operation of lowering the boom and pressing the arm. This makes it possible to reduce the ejection flow rate of the first hydraulic pump 15. Accordingly, the tilt of the first hydraulic pump 15 is set to a minimum value by the controller 14. When the controller 14 judges that the flow rate required for the first hydraulic pump 15 is secured, even if the number of rotations of the engine 5 is reduced at the time of a combined operation, the number of rotations of the engine 5 is reduced. In other words, as far as a flow rate required for the first hydraulic pump 15 is secured, it is possible to implement the control of reducing the number of rotations of the engine 5, even if the tilt of the first hydraulic pump 15 is not minimized.

Figure 6:
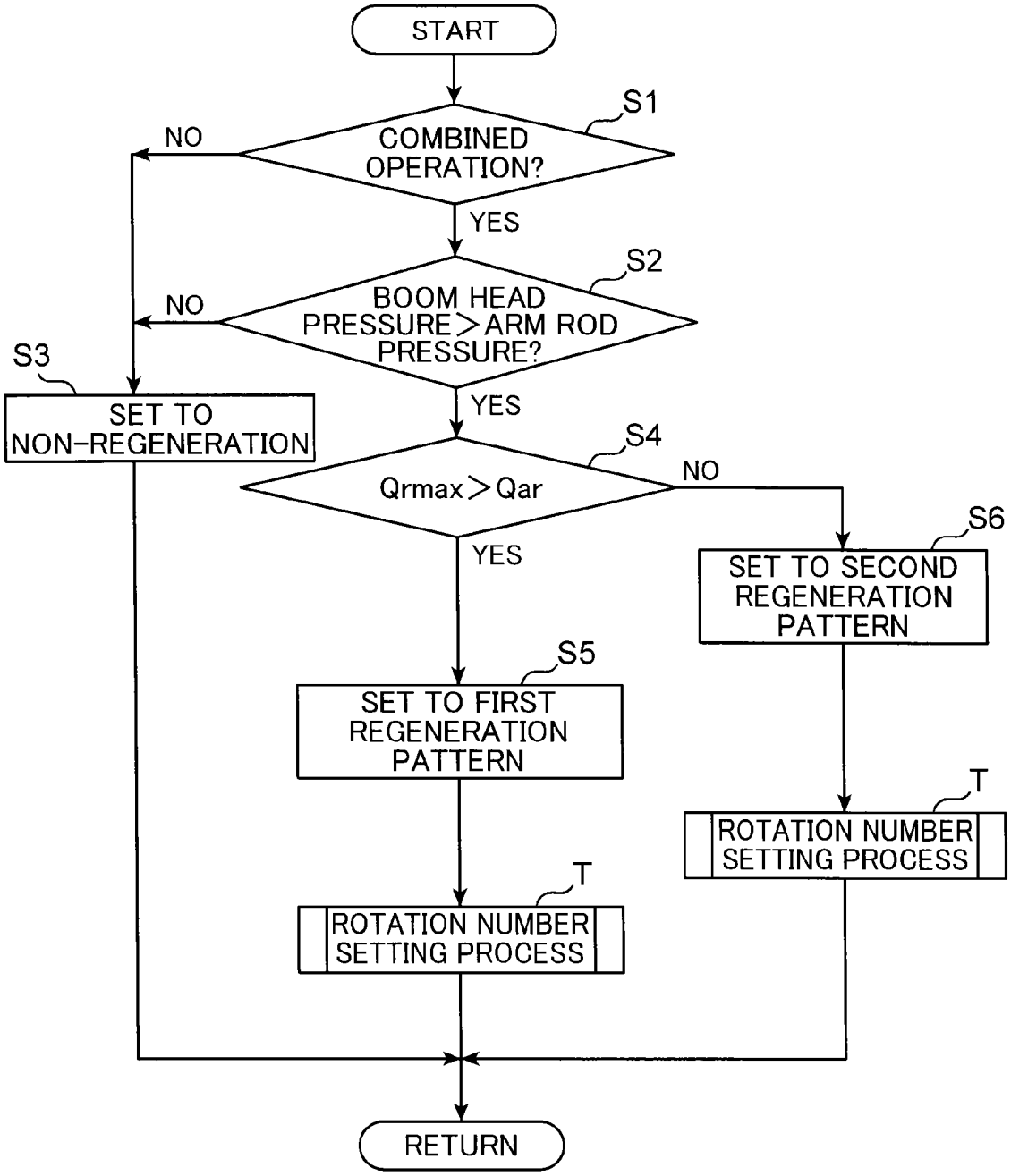
FIG. 6 is a flowchart illustrating a process to be executed by the controller illustrated in FIG. 3.

In the following, a process to be executed by the controller 14 is described referring to FIG. 6.

When a process by the controller 14 is started, it is determined whether a combined operation of lowering the boom and pressing the arm is performed (in Step S1). When it is determined that a combined operation is performed (YES in Step S1), it is determined whether the boom head pressure is larger than the arm rod pressure (in Step S2). When it is determined No in Step S1 and in Step S2, the process returns to Step S1, without performing regeneration (in Step S3).

On the other hand, when it is determined YES in Step S2, it is determined whether the maximum regeneration flow rate Qrmax is larger than the target flow rate Qar with respect to the arm cylinder 10 (in Step S4).

When it is determined YES in Step S4, the first regeneration pattern is set (in Step S5). On the other hand, when it is determined NO in Step S4, the second regeneration pattern is set (in Step S6). In other words, regeneration of hydraulic oil from the head side of the boom cylinder 9 to the rod side of the arm cylinder 10 is performed in Step S5 and in Step S6, and the ejection flow rate (tilt) of the second hydraulic pump 16 is reduced in accordance with the regeneration.

When Step S5 and Step S6 are executed, a rotation number setting process T of setting the number of rotations of the engine 5 is executed, and the process returns.

Figure 7:
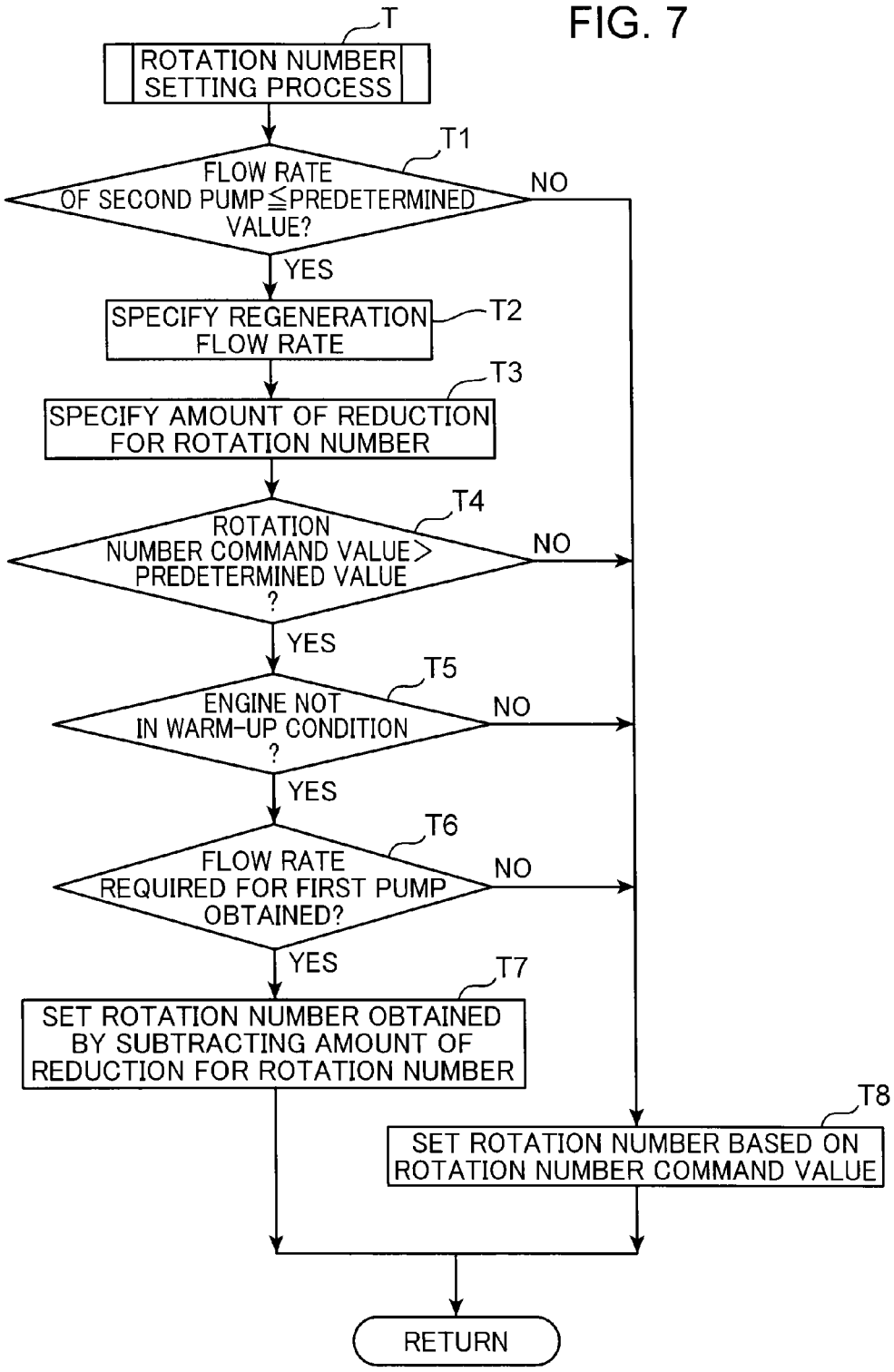
FIG. 7 is a flowchart illustrating a rotation number setting process illustrated in FIG. 6.

Referring to FIG. 7, when the rotation number setting process T is started, it is determined whether the ejection flow rate of the second hydraulic pump 16 is not larger than a predetermined value (in Step T1). In other words, in Step T1, it is determined whether the ejection flow rate of the second hydraulic pump 16 is a minimum flow rate, which cannot be reduced any more by tilting the second hydraulic pump 16.

Figure 4:
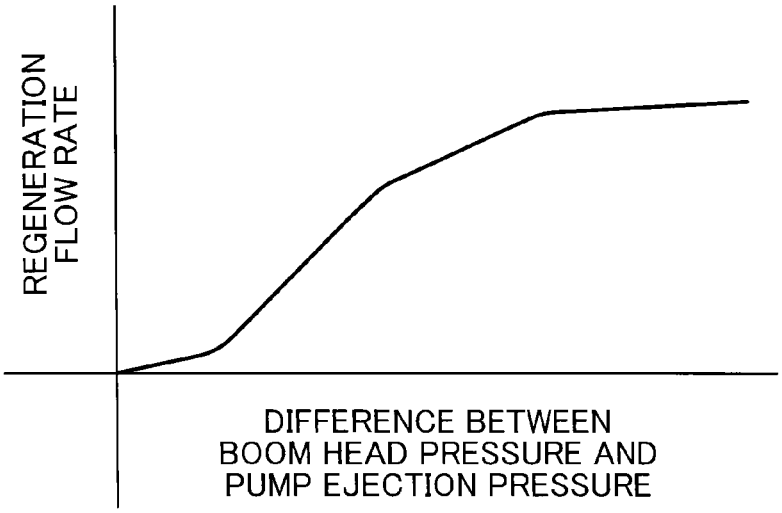
FIG. 4 is a map for specifying a regeneration flow rate stored in a storage unit illustrated in FIG. 3.

In Step T1, when it is determined that the ejection flow rate of the second hydraulic pump 16 is not larger than a predetermined value, a regeneration flow rate is specified, based on the map illustrated in FIG. 4, and based on the pressures detected by the pressure sensors P2 and P4 (in Step T2). In other words, there is specified a flow rate of hydraulic oil to be drawn into the rod side chamber of the arm cylinder 10 from the head side chamber of the boom cylinder 9 through the regeneration valve 22. Subsequently, an amount of reduction for the number of rotations of the engine 5 is specified, based on the regeneration flow rate specified in Step T2, and based on the map illustrated in FIG. 5 (in Step T3).

Subsequently, it is determined whether the command value indicating the rotation number, which is output from the rotation number designating unit 29, is larger than a predetermined value (in Step T4). In other words, in Step T4, it is determined whether the number of rotations of the engine 5 is the rotation number which is less likely to stop the engine 5, even if the rotation number is reduced.

When it is determined YES in Step T4, it is determined whether the engine 5 is in a warm-up condition (in Step T5). In other words, in Step T5, it is determined whether it takes time to recover the rotation number, when the number of rotations of the engine 5 is reduced.

When it is determined YES in Step T5, it is determined whether a flow rate required for the first hydraulic pump 15 is obtained when the number of rotations of the engine 5 is reduced by the amount of reduction specified in Step T3 (in Step T6). In other words, it is determined whether there is shortage in the flow rate required for the first hydraulic pump 15, even if the number of rotations of the engine 5 is reduced.

When it is determined YES in Step T6, the number of rotations of the engine 5 is set to the rotation number obtained by subtracting the amount of reduction for the rotation number specified in Step T3 from the rotation number based on a command from the rotation number designating unit 29 (in Step T7). According to this configuration, reducing the number of rotations of the engine 5 makes it possible to reduce the flow rate of the second hydraulic pump 16, which cannot be reduced any more by adjustment of the tilt. Thus, it is possible to reduce the drive loss of the second hydraulic pump 16.

On the other hand, when it is determined NO in Steps T1, T4, T5, and T6, the number of rotations of the engine 5 is set to the rotation number based on a command from the rotation number designating unit 29 (in Step T8). According to this configuration, it is possible to prevent the number of rotations of the engine 5 from lowering when there is no drive loss of the second hydraulic pump 16 (NO in Step T1). Further, it is possible to prevent the number of rotations of the engine 5 from lowering, when the engine 5 is driven at the rotation number which may likely to stop the engine 5 (NO in Step T4). Further, it is possible to prevent the number of rotations of the engine 5 from lowering, when the engine 5 is in a warm-up condition, which takes time to recover the number of rotations of the engine 5 (NO in Step T5). Further, it is possible to prevent the number of rotations of the engine 5 from lowering, when there is shortage in the flow rate of the first hydraulic pump 15 by reducing the number of rotations of the engine 5.

In the embodiment, Steps T4 and T5 for judging whether the number of rotations of the engine 5 is to be reduced are executed after Step T3 of calculating the amount of reduction for the rotation number. Alternatively, the order of these steps may be reversed. Specifically, it is possible to execute the step of calculating the amount of reduction for the number of rotations of the engine 5, after the step for preventing the number of rotations of the engine 5 from lowering is executed. According to the above modification, it is possible to omit the step for specifying the amount of reduction for the rotation number when reduction of the number of rotations of the engine 5 is prevented.

As described above, in the embodiment, the number of rotations of the engine 5 is set to be smaller than the rotation number designated by the rotation number designating unit 29 when the ejection flow rate of the second hydraulic pump 16 is not larger than a predetermined flow rate during a combined operation of lowering the boom and pressing the arm. In other words, in the embodiment, it is possible to reduce the flow rate of the second hydraulic pump 16 by reducing the number of rotations of the engine 5 in a condition, in which it is impossible to reduce the flow rate any more by tilting the second hydraulic pump 16 (e.g. in a condition, in which an ejection flow rate from the second hydraulic pump 16 is not expected). Thus, it is possible to sufficiently reduce the drive loss of the second hydraulic pump 16.

The ejection amount of the second hydraulic pump 16 is relatively determined by the magnitude of regeneration flow rate with respect to a flow rate (target flow rate Qar) required to be supplied to the arm cylinder 10. In view of the above, according to the embodiment, as illustrated in Step T3 in FIG. 7, it is possible to appropriately reduce the number of rotations of the engine 5 by directly determining the amount of reduction for the number of rotations of the engine 5, based on the regeneration flow rate.

Figure 5:
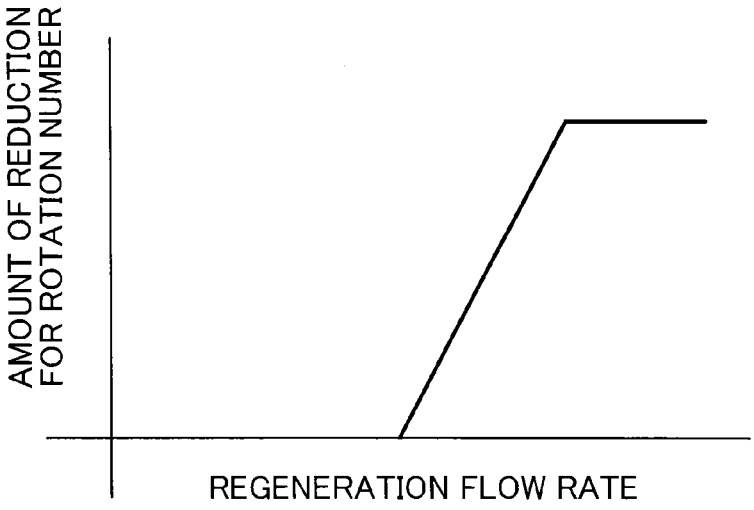
FIG. 5 is a map for specifying an amount of reduction for the rotation number stored in the storage unit illustrated in FIG. 3.

In the embodiment, whereas the amount of reduction for the number of rotations of the engine 5 increases, as the regeneration flow rate increases, and the amount of reduction for the number of rotations of the engine 5 decreases, as the regeneration flow rate decreases, based on the map illustrated in FIG. 5. Accordingly, it is possible to maximally reduce the number of rotations of the engine 5 during a combined operation, and to recover the number of rotations of the engine 5 during an excavation (at the time when the combined operation is finished), when the hydraulic shovel is ready for excavation by performing the combined operation of lowering the boom and pressing the arm. The above configuration makes it possible to continuously perform the work after a combined operation is finished, without giving discomfort to an operator. Thus, according to the embodiment, it is possible to enhance the fuel consumption rate by reducing the number of rotations of the engine 5, and to secure work efficiency after a combined operation is finished.

In the embodiment, as illustrated in Step T4 and in Step T8, reducing the number of rotations of the engine 5 is prohibited when the rotation number based on a command from the rotation number designating unit 29 is not larger than a predetermined rotation number. Thus, according to the embodiment, it is possible to reduce the number of rotations of the engine 5 as described above in the rotation number range, within which it is possible to prevent the engine 5 from stopping.

In the embodiment, as illustrated in Step T5 and in Step T8, reducing the number of rotations of the engine 5 is prohibited when the engine 5 is in a warm-up condition. When the engine 5 is in a warm-up condition, the viscosity of engine oil and hydraulic oil may increase, which may deteriorate the response in increasing the number of rotations of the engine 5. In view of the above, according to the embodiment, it is possible to avoid a difficulty in recovering the rotation number before a target time in a condition, in which it is necessary to recover (increase) the number of rotations of the engine 5.

Figure 8:
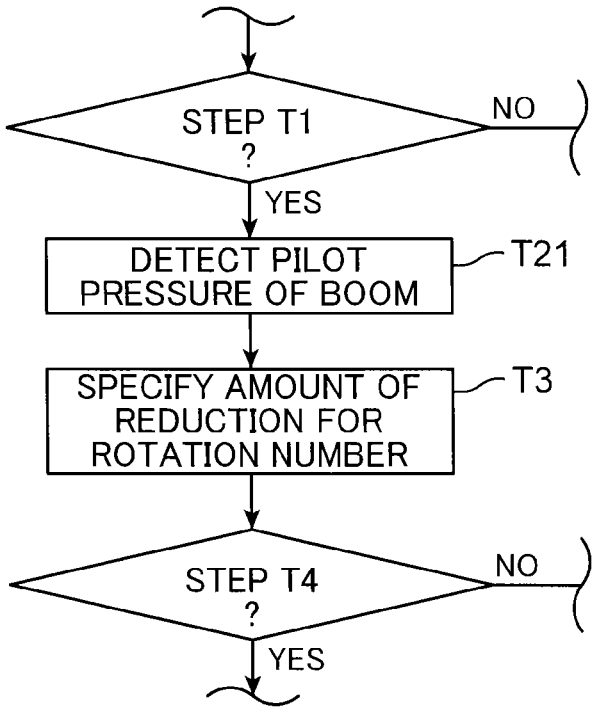
FIG. 8 is a flowchart illustrating another embodiment of the rotation number setting process.

In the following, another embodiment of the rotation number setting process T is described referring to FIG. 8 and FIG. 9. The elements substantially the same as those in the foregoing embodiment are indicated with the same reference signs, and the description thereof is omitted herein. The following embodiment is different from the foregoing embodiment in the contents of Step T2 and Step T3 of the rotation number setting process T.

Specifically, in Step T1, when it is determined that the flow rate of the second hydraulic pump 16 is not larger than a predetermined value (YES in Step T1), a pilot pressure for lowering the boom is detected by the pressure sensor P6 (see FIG. 2) (in Step T21).

Subsequently, an amount of reduction for the number of rotations of the engine 5 is specified, based on the pilot pressure detected in Step T21 (in Step T3). Specifically, a map illustrated in FIG. 9 is stored in advance in the storage unit 31 (see FIG. 3) in the embodiment. The map describes an amount of reduction for the rotation number with respect to a pilot pressure for lowering the boom. Accordingly, it is possible to specify the amount of reduction for the number of rotations of the engine 5, based on the pilot pressure detected in Step T21, and based on the map illustrated in FIG. 9.

Figure 9:
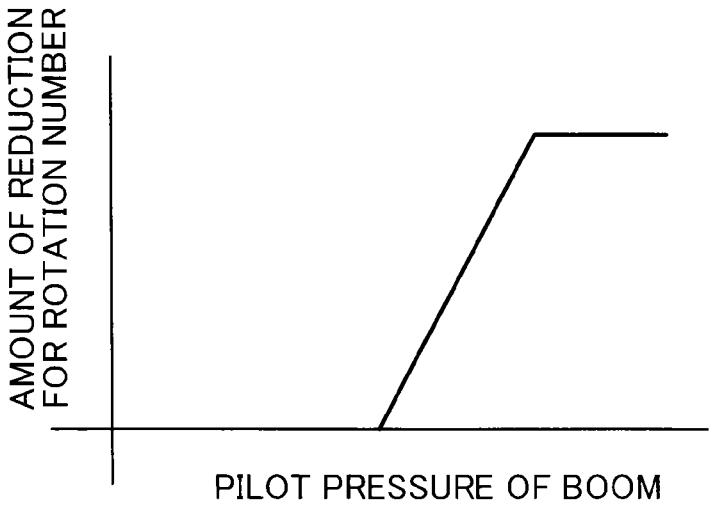
FIG. 9 is a map for specifying an amount of reduction for the rotation number stored in the storage unit illustrated in FIG. 3.

The map illustrated in FIG. 9 describes a range, in which the amount of reduction for the rotation number increases, as the pilot pressure increases, and dead zones on both sides of the range, in which the amount of reduction for the rotation number is constant regardless of an increase or a decrease in the pilot pressure.

There is a correlation between the pilot pressure (the operation amount of the first control valve 17), and the flow rate of return oil from the boom cylinder 9 (a flow rate enable to be regenerated with respect to the arm cylinder 10). According to the embodiment, it is possible to determine the amount of reduction for the number of rotations of the engine 5, utilizing the above correlation. Further, according to the embodiment, it is possible to determine the amount of reduction for the number of rotations of the engine 5, without the need of providing means for detecting a regeneration flow rate. This makes it possible to suppress an increase in the cost by addition of the rotation number control.

In the embodiment, whereas the amount of reduction for the number of rotations of the engine 5 increases, as the operation amount of the first control valve 17 increases, and the amount of reduction for the number of rotations of the engine 5 decreases, as the operation amount of the first control valve 17 decreases, based on the map illustrated in FIG. 9. Accordingly, it is possible to maximally reduce the number of rotations of the engine 5 during a combined operation, and to recover the number of rotations of the engine 5 during an excavation (at the time when the combined operation is finished), when the hydraulic shovel is ready for excavation by performing the combined operation of lowering the boom and pressing the arm. The above configuration makes it possible to continuously perform the work after a combined operation is finished, without giving discomfort to an operator.

The above embodiments mainly include inventions having the following configurations.

Specifically, the invention provides a control device for a construction machine including a machine body, a boom configured to be raised and lowered with respect to the machine body, and an arm configured to be swingable with respect to the boom. The control device is provided with a boom cylinder which raises and lowers the boom; an arm cylinder which swings the arm; a variable capacity hydraulic pump which supplies hydraulic oil to the arm cylinder; an engine which drives the hydraulic pump; a rotation number designating unit which outputs a command for designating the number of rotations of the engine; a regeneration valve which is switchable between a regeneration state, in which return oil from the boom cylinder at a time of lowering the boom is drawn into a supply side port of the arm cylinder at a time of pressing the arm, and a closed state, in which drawing of the return oil into the arm cylinder is prevented; flow rate detecting means which is configured to detect a value for specify an ejection flow rate of the hydraulic pump; and a controller which controls an operation of the regeneration valve so that the regeneration valve is switched to the regeneration state, and controls a flow rate of the hydraulic pump so as to reduce the ejection flow rate of the hydraulic pump in accordance with regeneration of hydraulic oil through the regeneration valve at a time of a combined operation of lowering the boom and pressing the arm. The controller outputs a command for setting the number of rotations of the engine to be smaller than the rotation number designated by the rotation number designating unit when the ejection flow rate of the hydraulic pump detected by the flow rate detecting means is not larger than a predetermined flow rate at the time of the combined operation.

According to the invention, when the ejection flow rate of the hydraulic pump is not larger than the predetermined flow rate at the time of the combined operation, the number of rotations of the engine is set to be smaller than the rotation number designated by the rotation number designating unit. In the specification, the term "predetermined flow rate" means a flow rate when the tilt of the hydraulic pump is minimized in a state that the engine is driven at the rotation number designated by the rotation number designating unit. In other words, according to the invention, it is possible to reduce the flow rate of the hydraulic pump by reducing the number of rotations of the engine in a condition, in which it is impossible to reduce the flow rate any more by the tilt of the hydraulic pump (e.g. in a condition, in which an ejection flow rate from the hydraulic pump is not expected). Thus, it is possible to sufficiently reduce the drive loss of the hydraulic pump.

In the control device, preferably, the controller may determine an amount of reduction for the number of rotations of the engine, based on a regeneration flow rate of hydraulic oil to be supplied from the boom cylinder to the arm cylinder through the regeneration valve.

The ejection amount of the hydraulic pump is relatively determined by the magnitude of regeneration flow rate with respect to a flow rate required to be supplied to the arm cylinder. In view of the above, according to the above configuration, it is possible to directly determine the amount of reduction for the ejection amount of the hydraulic pump (the amount of reduction for the number of rotations of the engine), with use of a regeneration flow rate. Thus, according to the above configuration, it is possible to appropriately reduce the number of rotations of the engine.

In the control device, preferably, the controller may determine the amount of reduction for the number of rotations of the engine to increase, as the regeneration flow rate increases.

According to the above configuration, whereas the amount of reduction for the number of rotations of the engine increases, as the regeneration flow rate increases, the amount of reduction for the number of rotations of the engine decreases, as the regeneration flow rate decreases. Accordingly, it is possible to maximally reduce the number of rotations of the engine during a combined operation, and to recover the number of rotations of the engine during an excavation (at the time when the combined operation is finished), when the construction machine is ready for excavation by performing the combined operation of lowering the boom and pressing the arm. The above configuration makes it possible to continuously perform the work after a combined operation is finished, without giving discomfort to an operator. Thus, according to the above configuration, it is possible to enhance the fuel consumption rate by reducing the number of rotations of the engine, and to secure work efficiency after a combined operation is finished.

In the above configuration, the expression "determine the amount of reduction for the number of rotations of the engine to increase, as the regeneration flow rate increases" means that the above relationship is established as far as the regeneration flow rate lies in a specific range. Alternatively, dead zones, in which the amount of reduction for the number of rotations of the engine is constant regardless of increase and decrease of the regeneration flow may be included on the outside of the specific range of the regeneration flow rate.

Preferably, the control device may be further provided with a supply-and-discharge control valve which controls supply and discharge of hydraulic oil to and from the boom cylinder; and an operation amount detecting unit which is configured to detect an operation amount of the supply-and-discharge control valve for lowering the boom. The controller determines an amount of reduction for the number of rotations of the engine, based on the operation amount of the supply-and-discharge control valve to be detected by the operation amount detecting unit.

There is a correlation between the operation amount of the supply-and-discharge control valve, and the flow rate of return oil from the boom cylinder (a regenerative flow rate with respect to the arm cylinder). Thus, according to the above configuration, it is possible to determine the amount of reduction for the number of rotations of the engine, without the need of providing means for detecting a regeneration flow rate. This makes it possible to suppress an increase in the cost by addition of the rotation number control.

In the control device, preferably, the controller may determine the amount of reduction for the number of rotations of the engine to increase, as the operation amount of the supply-and-discharge control valve to be detected by the operation amount detecting unit increases.

According to the above configuration, whereas the amount of reduction for the number of rotations of the engine increases, as the operation amount of the supply-and-discharge control valve increases, the amount of reduction for the number of rotations of the engine decreases, as the operation amount of the supply-and-discharge control valve decreases. Accordingly, it is possible to maximally reduce the number of rotations of the engine during a combined operation, and to recover the number of rotations of the engine during an excavation (at the time when the combined operation is finished), when the construction machine is ready for excavation by performing the combined operation of lowering the boom and pressing the arm. The above configuration makes it possible to continuously perform the work after a combined operation is finished, without giving discomfort to an operator. Thus, according to the above configuration, it is possible to enhance the fuel consumption rate by reducing the number of rotations of the engine, and to secure work efficiency after a combined operation is finished.

In the above configuration, the expression "determine the amount of reduction for the number of rotations of the engine to increase, as the operation amount of the supply-and-discharge control valve to be detected by the operation amount detecting unit increases" means that the above relationship is established, as far as the operation amount lies in a specific range. Alternatively, dead zones, in which the amount of reduction for the number of rotations of the engine is constant regardless of increase and decrease of the operation amount may be included on the outside of the specific range of the operation amount.

In the control device, preferably, the controller may determine whether the rotation number based on the command from the rotation number designating unit is not larger than a predetermined rotation number, and may output a command for driving the engine at the rotation number designated by the rotation number designating unit, when the rotation number based on the command from the rotation number designating unit is not larger than the predetermined rotation number, regardless that the ejection flow rate of the hydraulic pump detected by the flow rate detecting means is not larger than the predetermined flow rate at the time of the combined operation.

According to the above configuration, reducing the number of rotations of the engine is prohibited when the rotation number based on a command from the rotation number designating unit is not larger than the predetermined rotation number. In the specification, the term "predetermined rotation number" means a rotation number that defines the lower limit at which the engine is stopped. Thus, according to the above configuration, it is possible to reduce the number of rotations of the engine as described above in the rotation number range, within which it is possible to prevent the engine from stopping.

Preferably, the control device may be further provided with a warm-up detecting unit which detects a value for judging whether the engine is in a warm-up condition. The controller determines whether the engine is in the warm-up condition based on a detection value by the warm-up detecting unit, and outputs a command for driving the engine at the rotation number designated by the rotation number designating unit, when the engine is in the warm-up condition, regardless that the ejection flow rate of the hydraulic pump detected by the flow rate detecting means is not larger than the predetermined flow rate at the time of the combined operation.

According to the above configuration, reducing the number of rotations of the engine is prohibited when the engine is in a warm-up condition. When the engine is in a warm-up condition, the viscosity of engine oil and hydraulic oil may increase, which may deteriorate the response in increasing the number of rotations of the engine. In view of the above, according to the above configuration, it is possible to avoid a difficulty in recovering the rotation number in a condition, in which it is necessary to recover (increase) the number of rotations of the engine.

Further, the invention provides a construction machine including a machine body, a boom mounted on the machine body to be raised and lowered, an arm mounted on the boom to be swingable, and the control device having the above configuration.

INDUSTRIAL APPLICABILITY

According to the invention, it is possible to sufficiently reduce the drive loss of a hydraulic pump.

REFERENCE SIGNS LIST

P6 pressure sensor (operation amount detecting unit)
1 hybrid shovel (construction machine)
2 lower propelling body (machine body)
3 upper slewing body (machine body)
5 engine
5*a* cooling water sensor (warm-up detecting unit)
6 boom
7 arm
9 boom cylinder
10 arm cylinder
14 controller
16 second hydraulic pump
17 first control valve (supply-and-discharge control valve)
22 regeneration valve
29 rotation number designating unit
33 regeneration calculating unit

The invention claimed is:

1. A control device for a construction machine provided with a machine body, a boom configured to be raised and lowered with respect to the machine body, and an arm configured to be swingable with respect to the boom, the control device comprising:

a boom cylinder which raises and lowers the boom;

an arm cylinder which swings the arm;

a variable capacity hydraulic pump which supplies hydraulic oil to the arm cylinder;

an engine which drives the hydraulic pump;

a rotation number designating unit which outputs a command for designating the number of rotations of the engine;

a regeneration valve which is switchable between a regeneration state, in which return oil from the boom cylinder at a time of lowering the boom is drawn into a supply side port of the arm cylinder at a time of pressing the arm, and a closed state, in which drawing of the return oil into the arm cylinder is prevented;

flow rate detector configured to detect a value for specifying an ejection flow rate of the hydraulic pump; and a controller which controls an operation of the regeneration valve so that the regeneration valve is switched to the regeneration state, and controls a flow rate of the hydraulic pump so as to reduce the ejection flow rate of the hydraulic pump in accordance with regeneration of hydraulic oil through the regeneration valve at a time of a combined operation of lowering the boom and pressing the arm, wherein the controller outputs a command for setting the number of rotations of the engine to be smaller than the rotation number designated by the rotation number designating unit when the ejection flow rate of the hydraulic pump detected by the flow rate detector is not larger than a predetermined flow rate at the time of the combined operation.

2. The control device according to claim 1, wherein the controller determines an amount of reduction for the number of rotations of the engine, based on a regeneration flow rate of hydraulic oil to be supplied from the boom cylinder to the arm cylinder through the regeneration valve.

3. The control device according to claim 2, wherein the controller determines the amount of reduction for the number of rotations of the engine to increase, as the regeneration flow rate increases.

4. The control device according to claim 1, further comprising:

a supply-and-discharge control valve which controls supply and discharge of hydraulic oil to and from the boom cylinder; and an operation amount detecting unit which is configured to detect an operation amount of the supply-and-discharge control valve for lowering the boom, wherein the controller determines an amount of reduction for the number of rotations of the engine, based on the operation amount of the supply-and-discharge control valve to be detected by the operation amount detecting unit.

5. The control device according to claim 4, wherein the controller determines the amount of reduction for the number of rotations of the engine to increase, as the operation amount of the supply-and-discharge control valve to be detected by the operation amount detecting unit increases.

6. The control device according to claim 1, wherein the controller determines whether the rotation number based on the command from the rotation number designating unit is not larger than a predetermined rotation number, and outputs a command for driving the engine at the rotation number designated by the rotation number designating unit, when the rotation number based on the command from the rotation number designating unit is not larger than the predetermined rotation number, regardless that the ejection flow rate of the hydraulic pump detected by the flow rate detector is not larger than the predetermined flow rate at the time of the combined operation.

7. The control device according to claim 1, further comprising:

a warm-up detecting unit which detects a value for judging whether the engine is in a warm-up condition, wherein the controller determines whether the engine is in the warm-up condition based on a detection value by the warm-up detecting unit, and outputs a command for driving the engine at the rotation number designated by the rotation number designating unit, when the engine is in the warm-up condition, regardless that the ejection flow rate of the hydraulic pump detected by the flow rate detector is not larger than the predetermined flow rate at the time of the combined operation.

8. A construction machine comprising:

a machine body;

a boom configured to be raised and lowered with respect to the machine body:

an arm configured to be swingable with respect to the boom;

a boom cylinder which raises and lowers the boom;

an arm cylinder which swings the arm;

a variable capacity hydraulic pump which supplies hydraulic oil to the arm cylinder;

an engine which drives the hydraulic pump;

a rotation number designating unit which outputs a command for designating the number of rotations of the engine;

a regeneration valve which is switchable between a regeneration state, in which return oil from the boom cylinder at a time of lowering the boom is drawn into a supply side port of the arm cylinder at a time of pressing the arm, and a closed state, in which drawing of the return oil into the arm cylinder is prevented;

flow rate detector which is configured to detect a value for specifying an ejection flow rate of the hydraulic pump; and a controller which controls an operation of the regeneration valve so that the regeneration valve is switched to the regeneration state, and controls a flow rate of the hydraulic pump so as to reduce the ejection flow rate of the hydraulic pump in accordance with regeneration of hydraulic oil through the regeneration valve at a time of a combined operation of lowering the boom and pressing the arm, wherein the controller outputs a command for setting the number of rotations of the engine to be smaller than the rotation number designated by the rotation number designating unit when the ejection flow rate of the hydraulic pump detected by the flow rate detector is not larger than a predetermined flow rate at the time of the combined operation.

* * * * *